US006923121B2

(12) United States Patent
De Vroome

(10) Patent No.: US 6,923,121 B2
(45) Date of Patent: Aug. 2, 2005

(54) APPARATUS AND METHOD FOR REMOISTENING A PRODUCT WEB

(75) Inventor: Clemens Johannes Maria De Vroome, Beugen (NL)

(73) Assignee: Goss Contiweb B.V., Boxmeer (NL)

( * ) Notice: Subject to any disclaimer, the term of this patent is extended or adjusted under 35 U.S.C. 154(b) by 0 days.

(21) Appl. No.: 10/214,928

(22) Filed: Aug. 7, 2002

(65) Prior Publication Data

US 2003/0029343 A1 Feb. 13, 2003

(30) Foreign Application Priority Data

Aug. 7, 2001 (DE) ..... 101 38 743

(51) Int. Cl.[7] ..... B41L 35/14
(52) U.S. Cl. ..... 101/488; 101/483
(58) Field of Search ..... 101/487, 483, 101/488, 148, 147

(56) References Cited

U.S. PATENT DOCUMENTS

| | | | | |
|---|---|---|---|---|
| 1,250,894 A | | 12/1917 | Kately et al. | 34/629 |
| 3,198,199 A | | 8/1965 | Schultz | 134/122 R |
| 4,637,341 A | | 1/1987 | Switall | 118/694 |
| 5,062,919 A | | 11/1991 | McPherson et al. | 156/356 |
| 5,471,847 A | * | 12/1995 | Murray et al. | 62/91 |
| 5,619,927 A | | 4/1997 | Winheim | 101/487 |
| 5,676,754 A | | 10/1997 | Helms et al. | 118/101 |
| 6,082,150 A | * | 7/2000 | Stucker | 68/18 R |
| 6,176,180 B1 | * | 1/2001 | Taylor et al. | 101/148 |
| 6,318,263 B1 | * | 11/2001 | De Vroome | 101/424.1 |
| 6,376,024 B1 | * | 4/2002 | Siler et al. | 427/458 |
| 6,430,972 B1 | * | 8/2002 | Motzke | 68/205 R |

FOREIGN PATENT DOCUMENTS

| | | |
|---|---|---|
| DE | 84 33 273.5 U1 | 2/1985 |
| DE | 44 31 252 A1 | 3/1996 |
| DE | 88 17 284 U1 | 4/1997 |
| EP | 0 463 213 A1 | 1/1992 |

* cited by examiner

*Primary Examiner*—Anthony H. Nguyen
(74) *Attorney, Agent, or Firm*—Laurence A. Greenberg; Werner H. Stemer; Ralph E. Locher

(57) ABSTRACT

An apparatus for remoistening a product web includes at least one applicator for applying a remoistening agent to a printed and at least partly dried product web. A device increases the temperature of the remoistening agent so that contaminants are removed by vaporization from the remoistening agent. A combination of the apparatus with a dryer and a cooling device and a method for remoistening the product web are also provided.

20 Claims, 4 Drawing Sheets

6
18
1
20
24
56
58
66
62
64
60
22
52
50
54
16

6
18
1
20
40
24
46
48
44
42
22
16

APPARATUS AND METHOD FOR REMOISTENING A PRODUCT WEB

BACKGROUND OF THE INVENTION

Field of the Invention

The invention relates to an apparatus and method for remoistening a product web, in particular, a paper web in a web-fed rotary printing press.

During the printing of a product web, for example a paper web, the product web is unwound from a supply roll, guided through one or more printing units, which apply one or more colors to one or both sides of the product web, and subsequently guided through a dryer, for example, a hot air dryer, in order to dry the product web. In the hot air dryer, the product web is heated above a temperature level at which the solvent contained in the printing ink that is used evaporates and can be extracted by an extraction device belonging to the dryer. At the same time, however, a given moisture content is also removed from the product web, thereby having a detrimental effect upon the quality of the printed product to be produced. The product web is subsequently fed to a cooling device, for example, a chill roll stand comprising one or more chill rolls, the product web being cooled down by transferring heat to the chill rolls and, thereby, the printing ink is hardened.

In order to compensate for the removal of moisture in the dryer, it has become known heretofore to supply the necessary moisture to the product web again by a suitable device which is disposed downstream of the dryer. However, the product web coming out of the dryer entrains an air layer of given thickness therewith, wherein solvent and oil vapors can be contained, these vapors tending to be deposited on the surface, for example, of an applicator roller of a remoistening device or on the surface of a chill roll. As a result, during the sequential operation of the printing press, a build-up of condensed solvent or of condensed oil vapors may occur on the respective surfaces of the rollers or rolls, and the printed paper web may become smeared with the condensate.

German Published, Non-prosecuted Patent Application DE 44 05 332 A1 discloses a remoistening system, in particular, for web-fed rotary offset presses with heat-set drying, wherein a product web coming out of an oven is supplied to a large number of chill rolls. In order to provide a solution for the problem of the build-up of a solvent-ink mixture on the chill rolls, provision is made for supplying the web initially to a number of air knives, then to a remoistening chamber with a large number of water spraying or atomizing nozzles and, thereafter, to an additional spray nozzle system. The air knives, which have compressed air nozzles distributed over the web width, doctor the solvent off the web, the solvent being then extracted or sucked away via ducts and being able to be supplied to the dryer again. In the remoistening chamber, the droplets produced by the water atomization nozzles are partly evaporated by the heat of the hot web, so that, in addition, a damp mist forms in the chamber, the damp mist being picked up or accepted by the dried web. The additional spray nozzle system is installed directly upstream of the first chill roll and the second chill roll. The positioning of the spray nozzle system immediately before or upstream from where the web runs onto the chill rolls causes the sprayed-on moistening agent to be forcibly incorporated into the web as the web wraps around the chill rolls.

The combination of three devices for applying a moistening agent to the web with the simultaneous prevention of a build-up of solvent-ink mixture on the chill rolls, therefore, exhibits a complex construction, from which the problem arises that the solvent vapors entrained by the web condense on the many components of the three aforementioned devices, in particular, on the inner sides of the chamber walls, and from there pass back onto the moving product web.

Furthermore, U.S. Pat. No. 4,637,341 discloses a device for applying silicone oil-water emulsion to a paper web, it being possible for the emulsion to be brought by a heat exchanger to a desired temperature level, which may be higher or lower than the ambient temperature. In this applicating device, too, the problem arises of contaminating the silicone oil-water emulsion with contaminants, for example, ink residues, which can pass over the roll or roller surface into the storage trough for the emulsion.

SUMMARY OF THE INVENTION

It is accordingly an object of the invention to provide an apparatus and a method for remoistening a product web, which overcome the aforementioned disadvantages of the prior art. More specifically, it is an object of the invention to provide an apparatus for remoistening a product web, which has a simple construction, takes up little space, and can be cleaned or maintained with little time expenditure and low costs. A further or alternative object of the invention is to provide an apparatus which causes only little or virtually no contamination. A further or alternative object of the invention is to provide a method which, when it is carried out, reduces or nearly completely prevents contamination of an applicator roller.

With the foregoing and other objects in view, there is provided, in accordance with one aspect of the invention, an apparatus for remoistening a product web, comprising at least one applicator for applying a remoistening agent to a printed and at least partly dried product web. A device increases the temperature of the remoistening agent so that contaminants are removed by vaporization from the remoistening agent.

In accordance with another feature of the invention, the at least one applicator is an applicator roller having at least one of a metallic and a polished surface for applying the remoistening agent to the product web, and at least one storage container for receiving the remoistening agent therein.

In accordance with a further feature of the invention, the at least one applicator roller is separately drivable.

In accordance with an added feature of the invention, the at least one applicator for applying the remoistening agent serves simultaneously for heating the remoistening agent.

In accordance with an additional feature of the invention, the at least one applicator is an applicator roller through which a heated fluid is capable of flowing.

In accordance with yet another feature of the invention, the heated fluid is water.

In accordance with yet a further feature of the invention, the device for increasing the temperature of the remoistening agent consists of at least one of an electrically operated heating filament and a heat exchanger.

In accordance with yet an added feature of the invention, the heat exchanger is traversible by a heated fluid.

In accordance with another aspect of the invention, there is provided, in combination, an apparatus for remoistening a product web, arranged between a dryer and a cooling device.

In accordance with a further feature of the invention, in the combination, the apparatus is disposed directly upstream of the cooling device.

In accordance with an added feature of the invention, in the combination, the apparatus for remoistening a product web is arranged between a hot air dryer and a chill roll stand.

In accordance with an additional feature of the invention, in the combination, the apparatus is disposed directly upstream of a first chill roll of the chill roll stand.

In accordance with yet another feature of the invention, in the combination of the apparatus for remoistening a product and a cooling device, the apparatus is arranged in the cooling device.

In accordance with yet a further feature of the invention, the applicator is an applicator roller disposed directly upstream from a first chill roll of the chill roll stand for applying the remoistening agent to a side of the product web with which the product web is slung around the first chill roll.

In accordance with yet an added feature of the invention, the apparatus further comprises a first chill roll of a chill roll stand, the first chill roll serving as the applicator.

In accordance with yet an additional feature of the invention, the remoistening agent contains at least one of the substances consisting of water and silicone.

In accordance with still another feature of the invention, the apparatus further comprises at least one line via which the device for increasing the temperature of the remoistening agent is connected to the storage container.

In accordance with still a further feature of the invention, the product web is a paper web in a web-fed rotary offset printing machine.

In accordance with a further aspect of the invention, there is provided a web-fed rotary printing press having an apparatus for remoistening a product web, comprising at least one applicator for applying a remoistening agent to a printed and at least partly dried product web, and a device for increasing the temperature of the remoistening agent so that contaminants are removed by vaporization from the remoistening agent.

In accordance with a concomitant feature of the invention, there is provided a method for remoistening a product web, which comprises providing at least one applicator, applying with the applicator a remoistening agent to a printed and at least partly dried product web, and increasing the temperature of the remoistening agent so that contaminants are separated by vaporization from the remoistening agent.

An apparatus for remoistening a product web, in particular a paper web in a web-fed rotary printing press, the apparatus being equipped for applying a remoistening agent to the printed and at least partly dried product web, is distinguished by the fact that the thus equipped apparatus serves for heating the remoistening agent.

According to the invention, a device serves for heating the remoistening agent, as a result of which the temperature of the remoistening agent can be increased so that condensed solvent, oil vapors or the like which have gotten into the remoistening agent can be separated from the remoistening agent by vaporization. This advantageously avoids the situation wherein contamination of the remoistening agent by the condensed solvent or oil vapors gets back onto the product web through the device for applying the remoistening agent and, as a result, the quality of the product to be produced, for example, the printed product, is reduced. The contaminants driven out of the remoistening agent can preferably be extracted by an extraction device and, for example, supplied to a dryer and burned by the latter, with energy recovery and pollutant reduction.

A further embodiment of the invention can provide for the apparatus to comprise at least one applicator roller, in particular, an applicator roller with a metallic and/or polished surface, for applying the remoistening agent to the product web and/or at least one storage container for holding the remoistening agent, in particular, a trough.

Advantageously, through the use of an applicator roller which picks up and scoops, respectively, the remoistening agent from a trough and surrenders it to the product web, the application of the remoistening agent is achieved in a simple way and with few components.

Furthermore, provision can preferably be made to arrange the equipment for heating the remoistening agent in or on the storage container, for example, the trough, and in this way, by heating the remoistening agent, to separate contaminants by vaporization from the remoistening agent, in particular, to remove the contaminants from the trough.

It is also possible to provide the trough with a cover, which has an opening for the applicator roller to extend through and which is additionally connected to an extraction device which extracts the vaporized solvent or oil vapors which are located in the enclosed space belonging to the trough provided with the cover.

Furthermore, it is likewise advantageously possible to drive the applicator roller separately, for example, by a motor. However, provision can also be made for driving the applicator roller only by friction imparted by the product web. The use of a separate drive for the applicator roller advantageously permits the applicator roller to rotate at a desired speed of rotation and, in this way, if appropriate, to generate a desired slip between the surface of the applicator roller and the transported product web.

The applicator roller can expediently also cooperate with a counter-pressure roller, which is arranged on the other side of the product web.

In a further refinement of the invention, the device for applying the remoistening agent, for example, the applicator roller, can at the same time serve as the equipment for heating the remoistening agent.

For example, it is possible for a heated fluid, for example, water, to flow through the applicator roller and, by transferring heat, to heat the applicator roller, in particular, the surface of the latter, the remoistening agent being, in turn, heated by heat transfer so that the contaminants induced by the condensed solvent and oil vapors can be driven out of the remoistening agent by a vaporization or evaporation process.

In a further refinement of the invention, provision can be made for the equipment for heating the remoistening agent preferably to comprise an electrically operated heating filament and/or a heat exchanger, for example, a heat exchanger through which a heated fluid flows.

In this regard, provision can advantageously be made, for example, for arranging the heating filament and/or the heat exchanger within the trough from which the applicator roller or a dip roller scoops the remoistening agent, in order in this way to effect the heating of the remoistening agent simply and cost-effectively.

Furthermore, it is likewise possible to arrange the apparatus according to the invention between a dryer and a cooling device, in particular between a hot air dryer and a chill roll stand, or directly upstream of the cooling device, in particular, directly upstream of a first chill roll of the cooling device, or within the cooling device, in particular directly upstream of the first chill roll of the cooling device or chill roll stand.

By these preferred arrangements of the apparatus according to the invention, the deposition and build-up of solvent vapors, oil vapors or the like on components of the cooling device, in particular, on chill rolls of a chill roll stand, can be prevented.

For example, by the apparatus according to the invention being arranged upstream of the first chill roll, it is possible to implement a collecting device for the aforementioned vapors, so that time and costs of complicated cleaning operations are eliminated, and it is possible to dispense with cleaning devices causing additional costs.

The applicator roller can preferably be arranged directly upstream of the first chill roll and can apply the remoistening agent to a side of the product web with which the product web is slung or wrapped around the first chill roll. This advantageously ensures the prevention of condensation of the vapors on the first cooling roll and, at the same time, the desired remoistening of the product web is achieved.

It is also possible to arrange a further apparatus for remoistening the product web on a side of the product web which faces away from the first chill roll. The further apparatus can, for example, be arranged directly opposite a first apparatus or else between the first and a second chill roll. The further apparatus according to the invention moreover also ensures the prevention of a build-up of contaminants on the surface of the second chill roll.

In a further refinement of the apparatus according to the invention, provision can be made for the first chill roll to serve as applicator or the applicator roller.

This results in the advantage of possibly being able to dispense with a separate applicator roller, saving costs and material. In this regard, the chill roll can scoop the remoistening agent directly or via a dip roller from a storage container, for example, a trough.

It is moreover possible for the remoistening agent to contain water and/or silicone, it being possible, in particular, to provide separate control of the amount of the water component and/or the silicone component.

By separate control of the amount of the components, the operator is provided with the capability of setting the water and the silicone component at any time so that optimum wetting of the device for applying the remoistening agent, for example, an applicator roller, and also optimum remoistening of the product web, is achieved. In this regard, the separate control of the amount of the components can be effected manually by the user, but it is also conceivable for an automatic control device to perform the separate control of the component amounts.

A further embodiment of the invention can provide an external heating device, which comprises a storage container and a heating element, and which is connected via lines and at least one pump to a trough. It is therefore advantageously also possible to arrange the heating device, which takes up space, in particular, also the cabling thereof, physically separately from the applicator roller or, for example, even from a chill roll stand and, in this way, provide an operator with improved access to the printing press.

With the objects of the invention in view, there is also provided a method for remoistening a product web, in particular a paper web in a web-fed rotary printing press, which comprises providing at least one applicator for applying a remoistening agent to a printed and at least partly dried product web. The method is distinguished by raising the temperature of the remoistening agent so that contaminants are separated from the remoistening agent by vaporization.

With the objects of the invention in view, there is additionally provided a web-fed rotary printing press, in particular a web-fed rotary offset printing press, comprising an apparatus for remoistening a product web according to the invention.

Other features which are considered as characteristic for the invention are set forth in the appended claims.

Although the invention is illustrated and described herein as an apparatus and a method for remoistening a product web, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
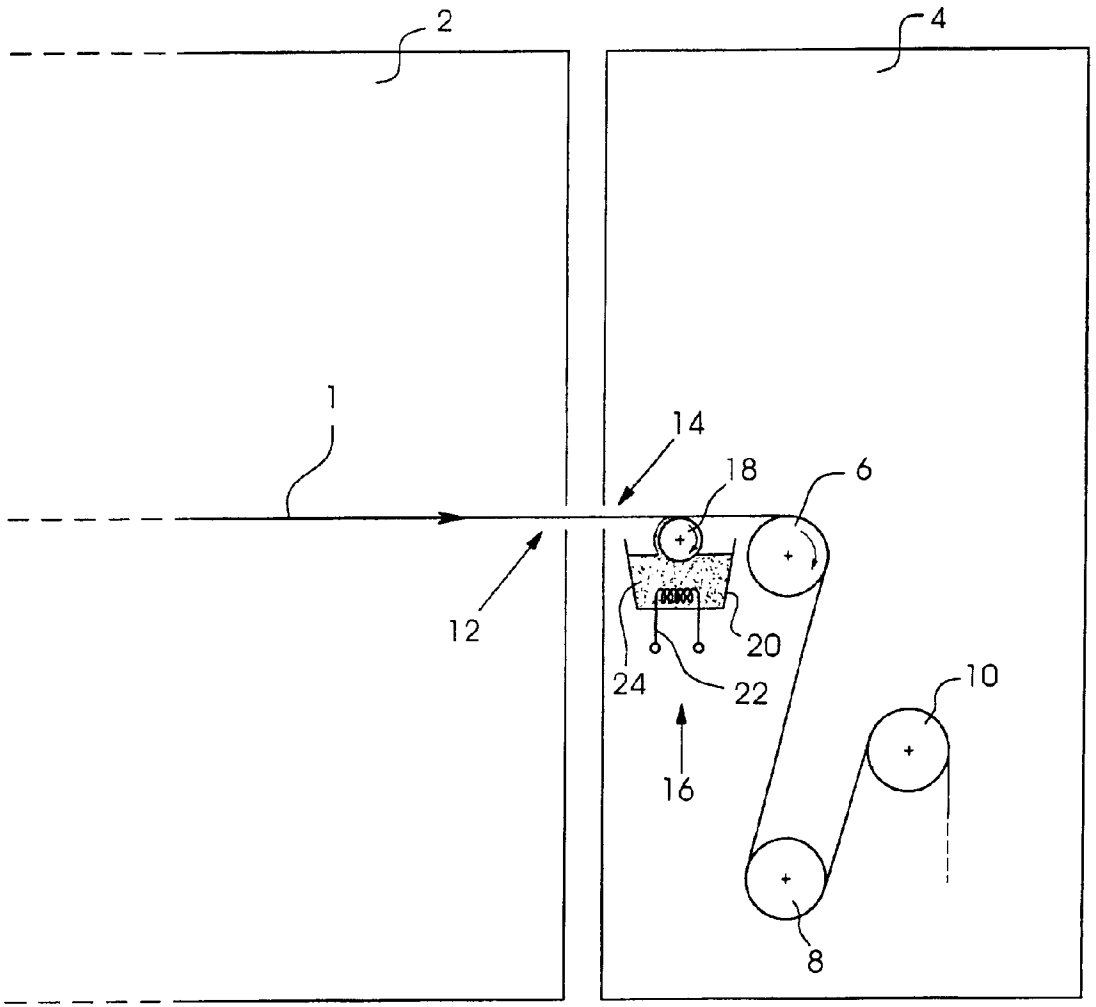
FIG. 1 is a diagrammatic, side-elevational view of the apparatus according to the invention in a chill roll stand disposed downstream from a dryer.

Referring now in detail to the figures of the drawings, in which corresponding features are identified by the same reference numerals, and first, particularly, to FIG. 1 thereof, there is seen a product web 1, for example a paper web, coming from a dryer 2 and being fed to a chill roll stand 4. The product web 1 is guided around a number of chill rolls 6, 8, 10 along the web path of the product web 1. The product web 1 leaves the dryer 2 through an opening 12 and enters the chill roll stand 4 likewise through an opening 14; provision can also be made for the two openings 12 and 14 to represent one and the same opening, which is provided in a dividing wall between the dryer 2 and the cooling roll stand 4 disposed downstream therefrom.

Arranged upstream from the first chill roll 6 of the chill roll stand 4 is an apparatus 16 according to the invention for remoistening the product web 1, which comprises an applicator roller 18, a trough 20 and a heating element 22. In the trough 20 is a given amount of remoistening agent 24 which, for example, can be composed of water and up to 30% silicone, and is picked up by the surface of the applicator roll 18 and surrendered or applied to one side of the product web 1. The heating element 22, which can be operated electrically, for example, serves to heat the remoistening agent 24 contained in the trough 20 so that residues of condensed solvent vapors, oil vapors or the like, which find there way into the remoistening agent via the applicator roller 18, can be removed from the remoistening agent 24 by increasing the temperature and by vaporization.

Figure 2:
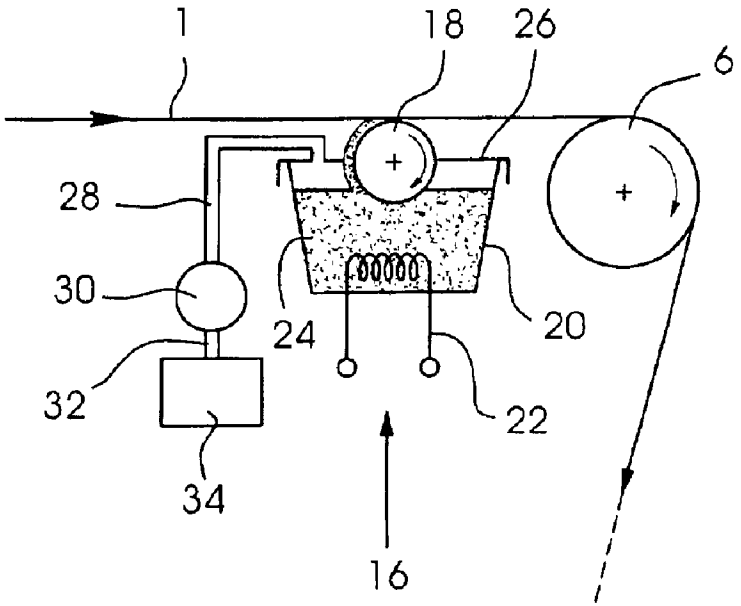
FIG. 2 is an enlarged, fragmentary view of FIG. 1 showing the apparatus according to the invention with an extraction device.

FIG. 2 likewise shows an apparatus for remoistening the product web 1, the apparatus also comprising, in addition to the applicator roller 18, the trough 20 and the heating element 22, a cover 26, through which the applicator roller 18 projects at least partly and is in contact with the remoistening agent 24. The cover 26, which can also be an integral component of the trough 20, is connected via a line 28 to a pump element 30, which is, in turn, connected via a line 32 to a container 34. The solvent and oil residues evaporated from the remoistening agent 24 are collected in the space enclosed by the cover 26 and the trough 20 and, via the lines 28 and 32 and with the aid of the pump element 30, are moved into a container 34 where, for example, they can be subjected to a recovery process by condensation. However, it is also possible to feed the vapors directly via the line 32 to the dryer 2 and to make the vapors available there to the combustion process, recovering energy and reducing pollutants. In this regard, the pump element 30 can also be replaced by a pump element located in the dryer 2.

Figure 3:
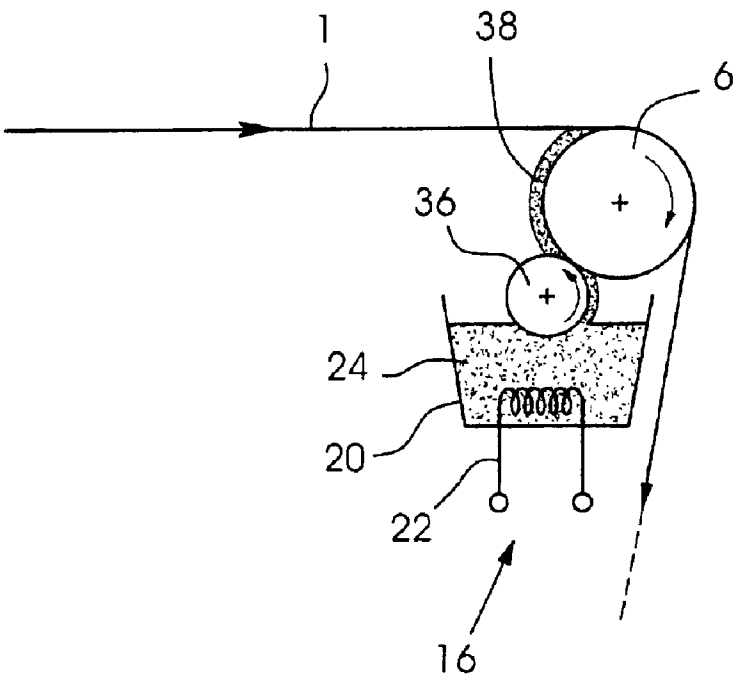
FIG. 3 is an enlarged, fragmentary view of FIG. 1 showing the apparatus according to the invention with an additional dip roller.

FIG. 3 also shows a remoistening apparatus 16 according to the invention, wherein a first chill roll 6 of a chill roll stand serves as the applicator roller. The remoistening agent 24 is scooped out of the trough 20 by a dip roller 36 and is transferred from the dip roller 36 to the chill roll 6 operating as an applicator roller, from which the remoistening agent film 38 is transferred onto one side of the product web 1.

An apparatus 16 according to FIG. 3 can also, however, be configured so that the remoistening agent 24 is scooped directly out of the trough 20 by the chill roll 6 and applied to one side of the product web 1.

Figure 4:
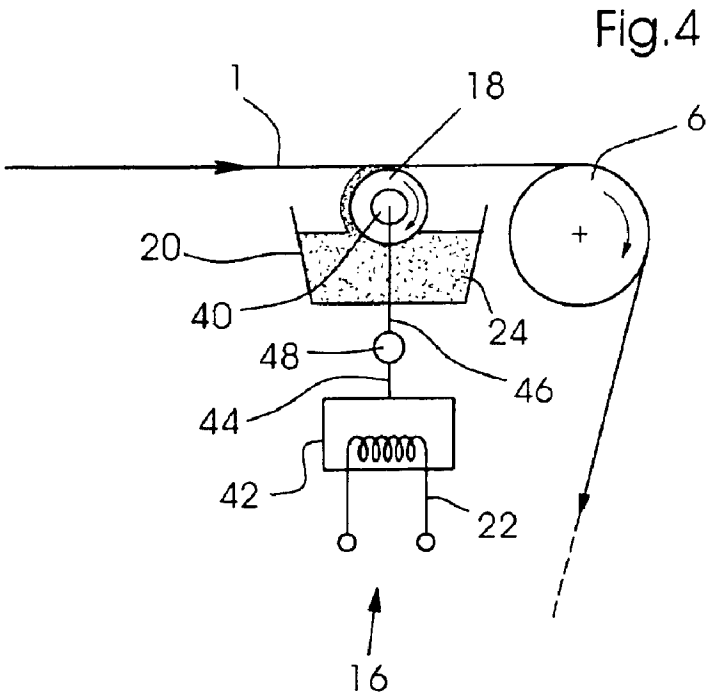
FIG. 4 is an enlarged, fragmentary view of FIG. 1 showing the apparatus according to the invention with an applicator roller serving for heating the remoistening agent.

FIG. 4 shows an apparatus 16 for remoistening a product web 1, wherein an applicator roller 18 is formed with a hollow interior 40, through which a heating medium, for example a heated fluid flows. The fluid, for example water can, in this regard, be heated by a heating device 22 in a storage container 42 and can be supplied to the hollow interior 40 of the applicator roller 18 via lines 44 and 46 with the aid of a pump element 48. The cover of the applicator roller 18 is heated by heat transfer and, again, due to heat transfer, there is an increase in the temperature of the remoistening agent 24 in the trough 20.

Figure 5:
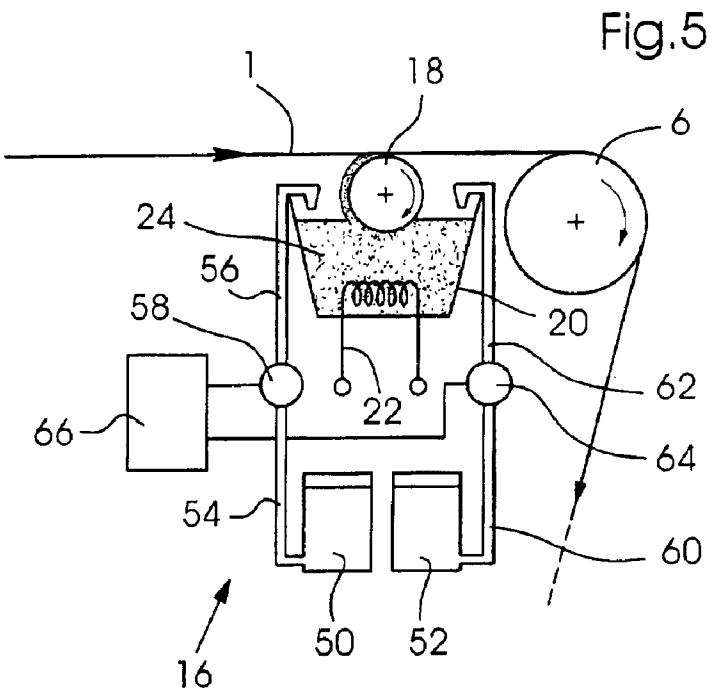
FIG. 5 is an enlarged, fragmentary view of FIG. 1 showing the apparatus according to the invention with a system for separately controlling proportionate amounts of water and of silicone.

FIG. 5 shows an apparatus 16 for remoistening a product web 1, which, as compared with the apparatus 16 shown in FIG. 1, comprises an apparatus for separately controlling the amounts of the water and/or silicone component of the remoistening agent 24. In this regard, a storage container 50 for water and a storage container 52 for silicone are provided, the water being supplied via lines 54 and 56 with the aid of a pump element 58, and the silicone being supplied via lines 60 and 62 with the aid of a pump element 64, from the respective storage containers 50 and 52 to the trough 20. A control device 66, which is connected to the pump element 58 and 64 and which, via non-illustrated measuring sensors, monitors the composition of the water-silicone mixture in the trough 20, controls the supply of water and silicone by the pump output of the respective pumps 58 and 64. In this regard, the control device 66 can be actuated by the operator or can automatically control the composition of the water-silicone mixture in the remoistening agent 24, for example, to a predefined or prescribed value.

It is preferably also possible to produce the water-silicone mixture outside the trough and then to supply it.

Figure 6:
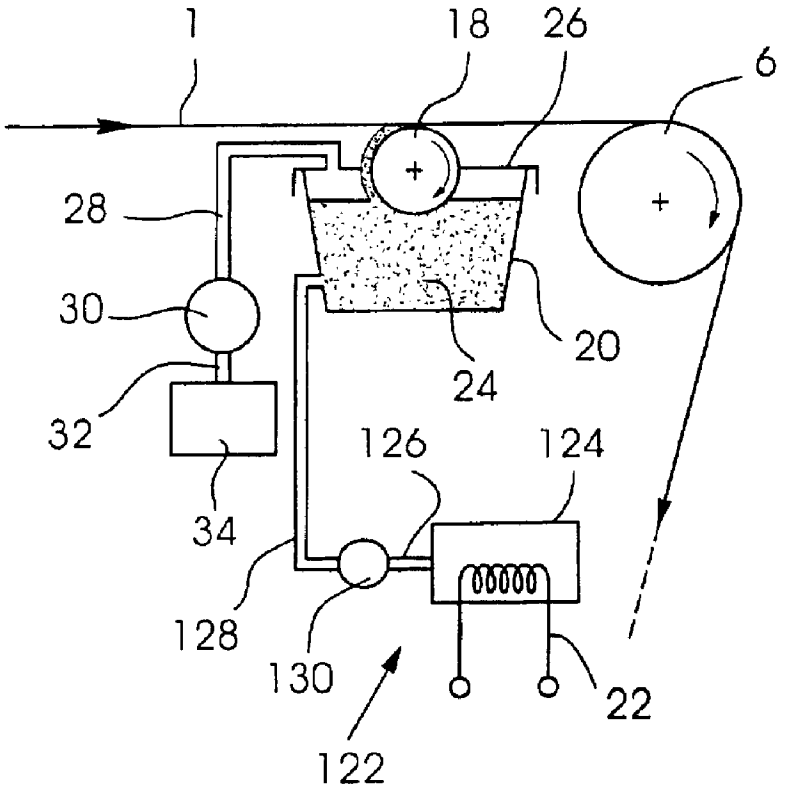
FIG. 6 is an enlarged, fragmentary view of FIG. 1 showing the apparatus according to the invention with an external heating device.

FIG. 6 shows an apparatus 16 for remoistening the product web 1, which is comparable with the apparatus shown in FIG. 2, but in this exemplary embodiment of the invention, instead of the heating elements 22 in the trough 20 (note FIG. 2), an external heating device 122 is provided. The heating device 122 comprises a storage container 124, wherein a remoistening agent 24 is stored and can be brought to a desired temperature by the heating element 22. Via lines 126 and 128 and by a pump 130, the temperature-control remoistening agent 24 can be supplied from the heating device 122 to the trough 20 as required. In this regard, a non-illustrated level sensor can be provided, which registers the level of the remoistening agent 24 in the trough 20 and reports the registered level to a likewise non-illustrated control device, which controls or else regulates the refilling of the remoistening agent 24 into the trough 20 by suitably driving the pump 130.

I claim:

1. An apparatus for remoistening a product web, comprising:

at least one applicator for applying a remoistening agent to a printed and at least partly dried product web; and a device for increasing a temperature of the remoistening agent, said device increasing the temperature of the remoistening agent to a level causing contaminates to be removed from the remoistening agent by vaporization.

2. The apparatus according to claim 1, wherein the at least one applicator is an applicator roller having at least one of a metallic and a polished surface for applying the remoistening agent to the product web, and at least one storage container for receiving the remoistening agent therein.

3. The apparatus according to claim 2, wherein said at least one applicator roller is separately drivable.

4. The apparatus according to claim 1, wherein said at least one applicator for applying said remoistening agent serves simultaneously for heating said remoistening agent.

5. The apparatus according to claim 4, wherein said at least one applicator is an applicator roller for conducting a flow of a heated fluid therethrough.

6. The apparatus according to claim 5, wherein said heated fluid is water.

7. The apparatus according to claim 1, wherein said device for increasing the temperature of the remoistening agent is at least one of an electrically operated heating filament and a heat exchanger.

8. The apparatus according to claim 7, wherein said heat exchanger is traversible by a heated fluid.

9. A combination, comprising: a dryer, a cooling device, and an apparatus for remoistening a product web according to claim 1, said apparatus for remoistening a product web being disposed between said dryer and said cooling device.

10. The combination according to claim 9, wherein said apparatus is disposed directly upstream of said cooling device.

11. A combination, comprising: a hot air dryer, a chill roll stand, and an apparatus for remoistening a product web according to claim 1, said apparatus for remoistening a product web being disposed within said chill roll stand.

12. The combination according to claim 11, wherein said apparatus is disposed directly upstream of a first chill roll of said chill roll stand.

13. A combination, comprising: a cooling device, and an apparatus for remoistening a product web according to claim 1, said apparatus for remoistening a product web being disposed in said cooling device.

14. The apparatus according to claim 1, wherein said applicator is an applicator roller disposed directly upstream of a first chill roll of a chill roll stand for applying said remoistening agent to a side of the product web with which the product web is slung around said first chill roll.

15. The apparatus according to claim 1, which further comprises a first chill roll of a chill roll stand, said first chill roll serving as said applicator.

16. The apparatus according to claim 1, wherein the remoistening agent contains at least one of the substances water and silicone.

17. The apparatus according to claim 2, further comprising at least one line via which said device for increasing the temperature of the remoistening agent is connected to said storage container.

18. A web-fed rotary printing press having an apparatus for remoistening a product web, comprising:

at least one applicator for applying a remoistening agent to a printed and at least partly dried product web; and a device for increasing a temperature of the remoistening agent, said device increasing the temperature of the remoistening agent to a level causing contaminates to be removed from the remoistening agent by vaporization.

19. A method for remoistening a product web, which comprises:

providing at least one applicator;

applying a remoistening agent to a printed and at least partly dried product web with the applicator; and increasing a temperature of the remoistening agent to a level causing contaminates to be removed from the remoistening agent by vaporization.

20. The apparatus according to claim 1, wherein the product web is a paper web in a web-fed rotary printing press.

* * * * *